United States Patent [19]

Edwards et al.

[11] Patent Number: 4,900,270

[45] Date of Patent: Feb. 13, 1990

[54] CABLE ADAPTOR ASSEMBLY

[75] Inventors: Mary S. Edwards, Grand Blanc; Max M. Dubrinsky, West Bloomfield, both of Mich.

[73] Assignee: Safe Stress, Inc., Grand Blanc, Mich.

[21] Appl. No.: 303,617

[22] Filed: Feb. 24, 1989

[51] Int. Cl.[4] ..... H01R 11/00

[52] U.S. Cl. ..... 439/502; 439/173; 439/223

[58] Field of Search ..... 439/173, 222, 223, 369, 439/502, 505, 503

[56] References Cited

U.S. PATENT DOCUMENTS

| | | | |
|---|---|---|---|
| 2,306,206 | 12/1942 | Dalgleish | 439/502 |
| 2,989,719 | 6/1961 | Aarlaht | 439/173 |
| 4,026,621 | 5/1977 | Korba | 439/502 |
| 4,394,057 | 7/1983 | Williams et al. | 439/502 |
| 4,664,459 | 5/1987 | Flanagan et al. | 439/502 |
| 4,721,479 | 1/1988 | Shuman | 439/505 |
| 4,723,822 | 2/1988 | Merdic | 439/502 |
| 4,815,991 | 3/1989 | Bakke | 439/502 |

*Primary Examiner*—P. Austin Bradley

*Attorney, Agent, or Firm*—Dykema Gossett

[57] ABSTRACT

A cable adaptor assembly is disclosed that allows any type of plug to be adapted to any type of socket. The arrangement consists of at least two cable members each having a plug and socket separated by an electric cord wherein the plug and socket on any given cable member are of distinct configurations. This assembly allows an operator to quickly adapt a given electric plug from an appliance to a particular wall outlet.

21 Claims, 3 Drawing Sheets

20
21
22
24
26
28
30
32
34
36
38
40
42
44
46

CABLE ADAPTOR ASSEMBLY

BACKGROUND OF THE INVENTION

This invention in general relates to a cable adaptor assembly or arrangement that can be used to adapt any type of electric power plug to a similar voltage and amperage socket that is of a distinct configuration.

Modern electrical plugs and sockets may have any one of several configurations for any particular voltage, amperage or phase. That is, for a 220 volt, 20 amp plug, there are at least two configurations of plug and socket, including as an example a straight-inserted plug and socket and a twist-inserted plug and socket. There may also be several configurations of straight and twist locks. For lower levels of electrical power, such as common household current and voltage, adaptors are known that adapt a three-pronged plug having a ground prong into a two-plug socket. These type of adaptors do not really adapt a particular configuration of plug to a distinct configuration of socket, but merely eliminate the safety prong on a particular plug. Problems arise with this type of adaptor since they are in essence a small electric plug that fits onto the end of the plug that is to be adapted. Since they are small and fit over the plug that is to be adapted, they are often difficult to work with. In addition, the electrical plug members are left exposed and when stored may be bent or damaged.

It is an object of the present invention to provide a cable adaptor arrangement that can be utilized to adapt any configuration of plug or socket to a corresponding plug or socket of the same voltage, amperage and phase.

In addition, it is an object of the present invention to provide such a cable adaptor arrangement in which the plug members will be protected while the device is being stored.

It is further an object of the present invention to provide such a cable adaptor arrangement in which the adaptor member is relatively long, thus being easy to work with and acting as an electrical extension cord.

SUMMARY OF THE INVENTION

The present invention discloses a cable adaptor assembly or arrangement that may be universally utilized with any type of plug and socket configuration. A disclosed embodiment of the invention comprises two different cable members, each having a plug and socket with an intermediate cord that is relatively long with respect to the plug and socket members. A first cable member comprises a type A male plug member and a type B female socket member. The second cable member comprises a type B male plug member and a type A female socket member; type A and B being names given here to two distinct configurations of plug and socket, for instance 220 volts, 20 amps, straight-insert and twist-lock configurations. In any electrical environment that has two commonly used configurations of plug and socket this arrangement will allow either type of plug to be adapted to use either type of socket. That is, if a particular appliance had a type A plug and the wall socket that it was to be utilized with had a type B socket, the cable member with the type A female socket and type B male plug would be attached to the appliance cord, and thus the appliance would be adapted for use with that particular wall socket.

An important use envisioned for this invention is with a power shut-off device in combination with a treadmill exercise machine. The shut-off device is inserted on the power line from the treadmill heading to the wall socket. Since this device is to be used with standard treadmills, it is envisioned that the treadmill may have a different configuration of plug than the socket member on the shut-off device and, in addition, the wall socket that the shut-off device is to be in turn inserted into may be of different configuration than the shut-off plug member. Thus, the combination of the two-part cable member disclosed by the cable adaptor arrangement of the present invention will allow the treadmill plug to be adapted into the shut-off device, and the shut-off device in turn to be adapted into the particular wall socket.

An important feature of the present invention is that it may be stored in a ring, thus protecting the plug members of the two cable parts. That is, the type A male plug of the first cable member may be received within the type A female socket of the second cable member, and the type B male plug of the second cable member may be received within the type B female socket portion of the second cable member, thus resulting in a ring that will act to protect the plug members of both cable portions and facilitate storage.

In addition, this arrangement is readily usable, since the cord separating the plug and socket on each of the cable portions is relatively long with respect to the plug and socket member, allowing it to be easily attached and also acting as an extension cord.

For electrical applications in which the particular voltage, amperage and phase may have more than two configurations, it is envisioned that a three-part (or more) cable adaptor assembly would be valuable. For instance, if there are three types of electrical configurations for a particular application, nominally called type A, type B and type C, a three-part cable adaptor arrangement would be valuable. The first cable would have a type A male plug and a cord connecting the male plug to a type B female socket. The second cable would have a type B male plug and a cord connecting the plug to a type C female socket. The third cable would have a type C male plug and a cord connecting this plug to a type A female socket. Thus, this arrangement would also have the ring-like storage configuration and would allow any one of the three types of plugs to be adapted to any one of the three types of possible socket arrangements.

In an embodiment of the invention the cord connecting the cable plug and socket is 10 inches long and 12 gauge wire.

If more configurations are commonly used the number of cables could be correspondingly raised.

These and other features and objects of the present invention can be best understood from the specification and appended drawings, of which the following is a brief description thereof.

DETAILED DESCRIPTION OF THE PREFERRED EMBODIMENT

The cable adaptor arrangement of the present invention can be best understood upon review of FIGS. 1–5.

Figures 1, 5:
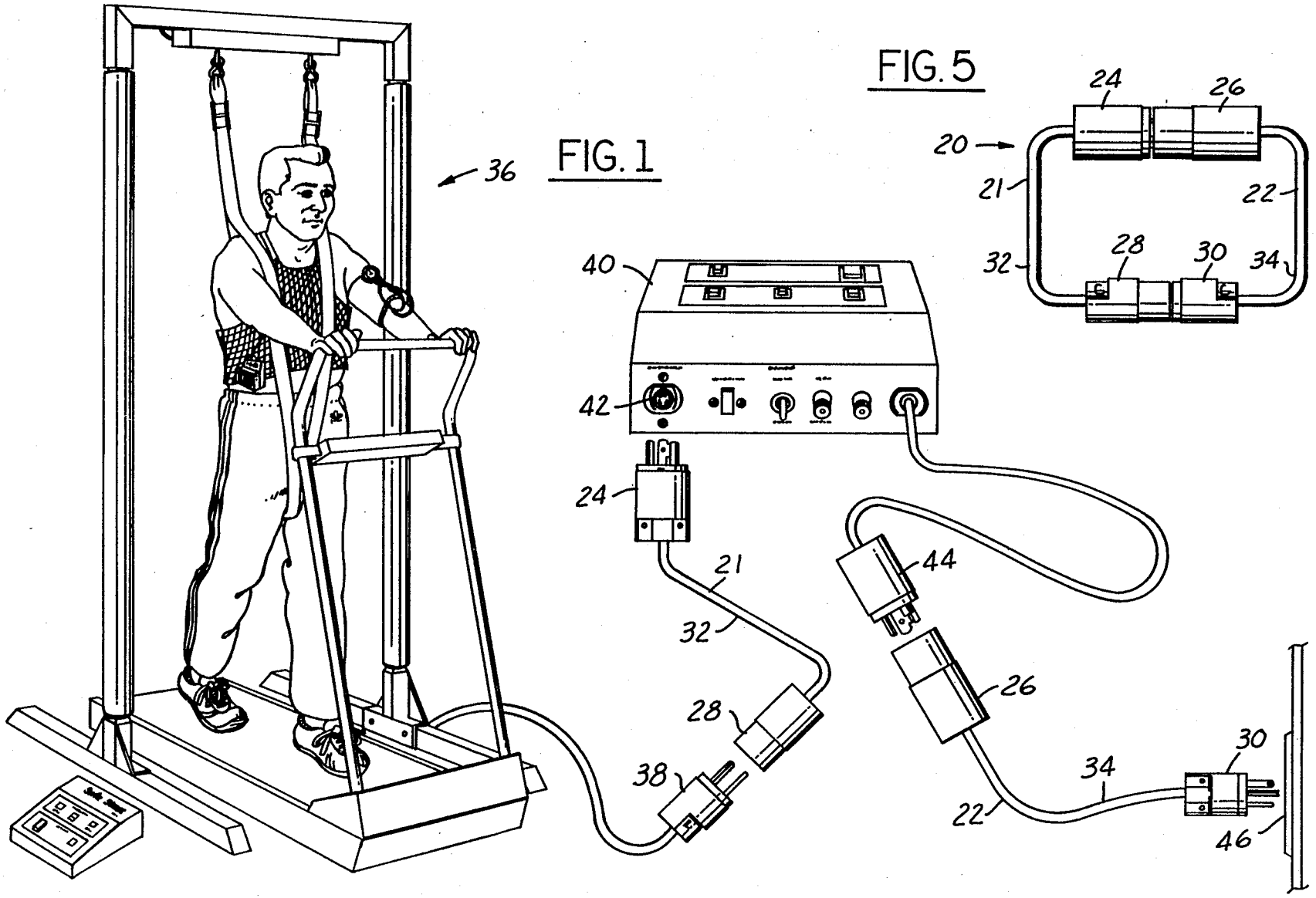
FIG. 1 is a plan view showing the cable adaptor assembly or arrangement of the present invention being utilized with a treadmill having a power shut-off unit mounted intermediate the power line thereof.
FIG. 5 shows the two-part cable adaptor assembly of the present invention in its stored ring-like configuration.

As shown in FIG. 5, the cable adaptor assembly or arrangement 20 of the present invention consists of first cable member 21 and second cable member 22. The first cable member 21 has male plug member 24 that is received in female socket member 26 of second cable member 22 which in turn has male plug member 30 received in female socket 28 of first cable member 21. Plug 24 and socket 28 of first cable member 21 are interconnected by a cord 32 that is of much greater length than the extent of the plug and socket members. Similarly, the second cable member 22 has its socket 26 connected to its plug 30 by a cord 34. As can be seen from FIG. 5, this allows storage in a ring or circular arrangement that protects the plugs 24 and 30 while they are being stored. That is, sockets 26 and 28 receive and protect the prongs from plugs 24 and 30, respectively, while the cable adaptor arrangement is being stored out of use. In addition, the ring-like shape allows the assembly to be easily stored, such as by hanging on a hook.

A first use of the cable adaptor assembly or arrangement 20 of the present invention is shown in FIG. 1 for adapting a power shut-off device mounted intermediate the power line of a treadmill. As shown in FIG. 1, treadmill unit 36 is of conventional design and has electric plug 38 that is to be inserted into shut-off unit 40 at socket 42. Shut-off unit 40 in turn has plug member 44 that is to be inserted into wall socket 46. Problems arise with this type of arrangement since there are more than one type of configuration of electrical plug and socket member that are commonly found. That is, plug 38 may be of a first configuration, while socket 42 may be arranged to receive a different configuration of plug, and the plug 44 may be of a different configuration than the wall socket 46. It is to be understood that on a single item such as shut-off unit 40, the socket 42 will normally be of the same configuration as plug 44. The cable adaptor arrangement 20 of the present invention allows an operator to adapt the plug 38 to socket 42 and plug 44 to wall outlet 46, even if they are of different configurations.

As shown in FIG. 1, first cable member 21 consists of female socket 28 that may correspond to plug 38, hereinafter called a type A plug or socket configuration, and a male plug 24 that corresponds to the configuration of socket 42, hereinafter called a type B socket or plug configuration. As can also be seen, the second cable member 22 has female socket member 26 that may correspond to plug 44 of a B configuration and plug 30 of an A configuration and corresponding to wall outlet 46. This allows an operator to adapt plug 38 to socket 42 and plug 44 to wall outlet 46.

Figure 2A:
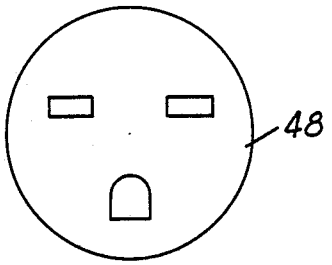
FIG. 2A is a configuration of a plug or socket for use with 220 volts, 15 amps and straight blade insertion.
Figure 2E:
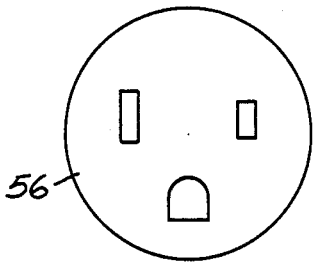
FIG. 2E is a plug and socket configuration for use with 120 volts, 15 amps and straight-blade insertion.
Figure 2B:
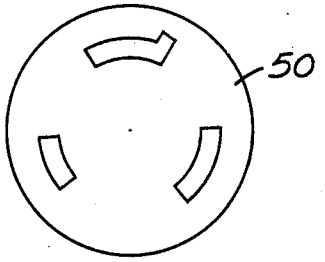
FIG. 2B is a plug and socket configuration for use with 220 volts, 15 amps and twist-lock insertion.
Figure 2F:
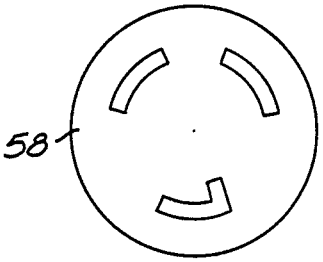
FIG. 2F is a plug and socket configuration for use with 120 volts, 15 amps and twist-lock insertion.
Figure 2C:
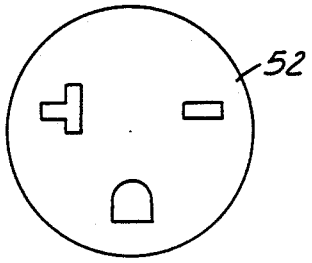
FIG. 2C is a plug and socket configuration for use with 220 volts, 20 amps and straight-blade insertion.
Figure 2G:
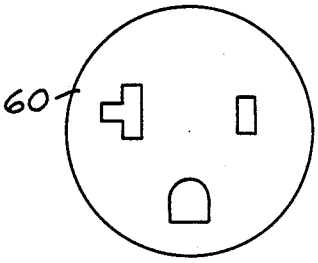
FIG. 2G is a plug and socket configuration for use with 120 volts, 20 amps and straight-blade insertion.
Figure 2D:
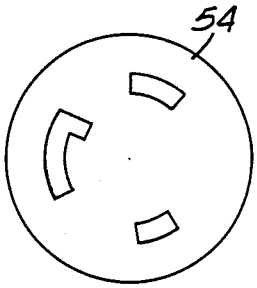
FIG. 2D is a plug and socket configuration for use with 220 volts, 20 amps and twist-lock insertion.
Figure 2H:
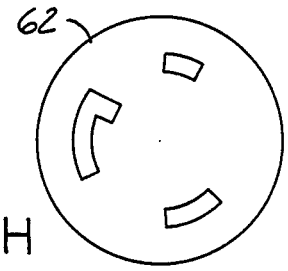
FIG. 2H is a plug and socket configuration for use with 120 volts, 20 amps and twist-lock insertion.

FIGS. 2A–2H show various configurations of plugs and sockets that are commonly found. This list is not meant to be limiting. FIG. 2A shows a plug and socket configuration 48 commonly found on 220 volt, 15 amp lines using straight-blade insertion. FIG. 2B shows a plug and socket configuration 50 commonly found on 220 volt, 15 amp lines using twist-lock insertion. FIG. 2C shows a plug and socket configuration 52 commonly used on 220 volt, 20 amp lines with straight-blade insertion. FIG. 2D shows a plug and socket configuration 54 that is commonly used on 220 volt, 20 amp lines using twist-lock insertion. FIG. 2E shows a plug and socket configuration 56 that is commonly used on 120 volt, 15 amp lines using straight-blade insertion. FIG. 2F shows a plug and socket configuration 58 that is commonly used on 120 volt, 15 amp lines using a twist-lock insertion. FIG. 2G shows a plug and socket configuration 60 commonly used on 120 volt, 20 amp lines using straight-blade insertion. FIG. 2H shows a plug and socket configuration 62 commonly used on 120 volt, 20 amp lines using twist-lock insertion.

An example of the cable adaptor assembly 20 would have a type A configuration as shown in FIG. 2A and a type B configuration as shown in FIG. 2B. Also FIGS. 2C and 2D could be substituted, or FIGS. 2E and 2F, or FIGS. 2G and 2H, or any other configurations.

Figure 3:
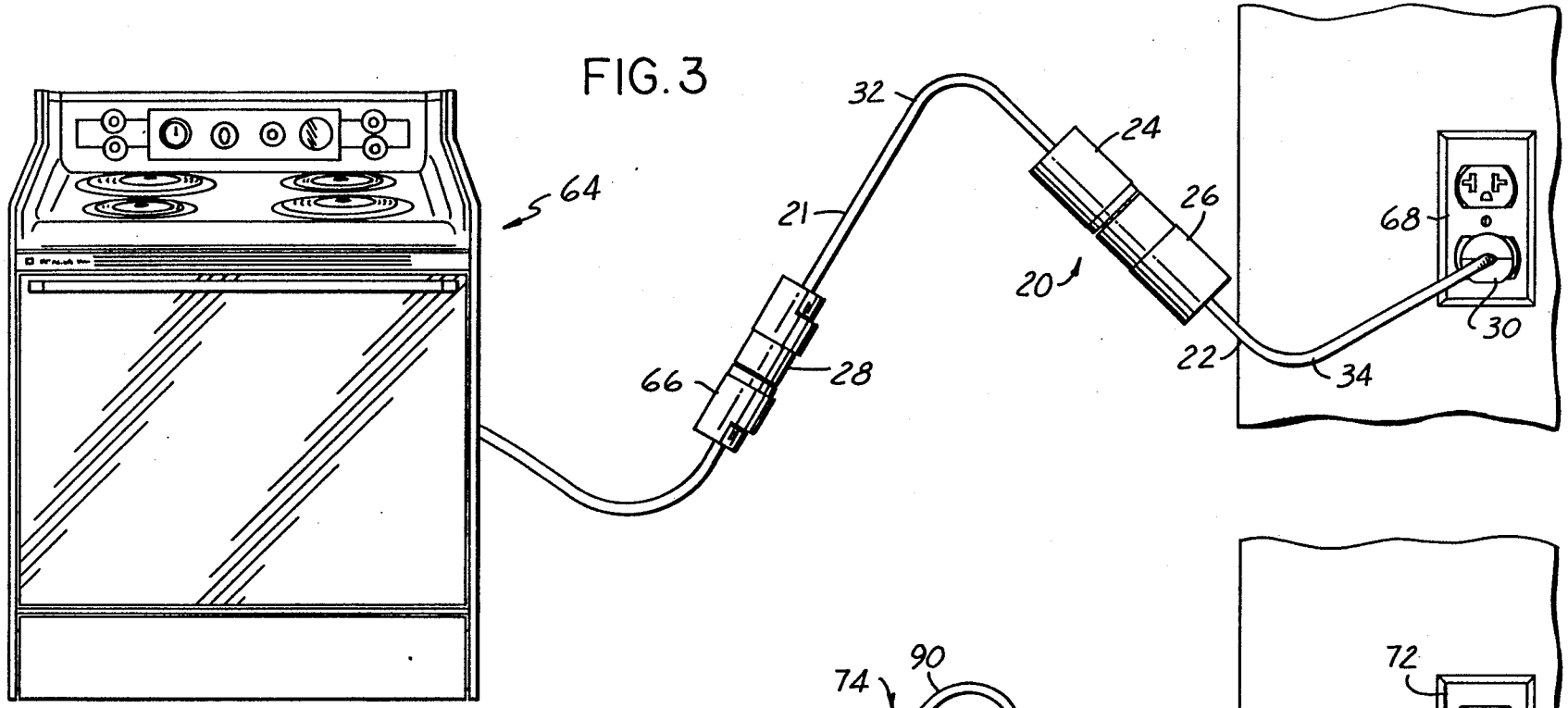
FIG. 3 is a plan view showing the use of the cable adaptor assembly of the present invention acting as an extension cord between an electric appliance and a wall socket outlet.

FIG. 3 illustrates an appliance, such as range 64, with power plug 66 being used with wall outlet 68. Cable adaptor assembly 20 is shown acting as an extension cord. First cable member 21 has socket member 28 receiving plug 66 and plug 24 being inserted into socket 26 of the second cable member 22 which in turn has its plug 30 inserted into wall outlet 68. Thus, cable adaptor assembly 20 of the present invention provides flexibility in that any type of plug can be adapted for use with any type of corresponding outlet, but in addition, the cable members themselves act as an extension cord either when used individually or when both are used.

Figure 4:
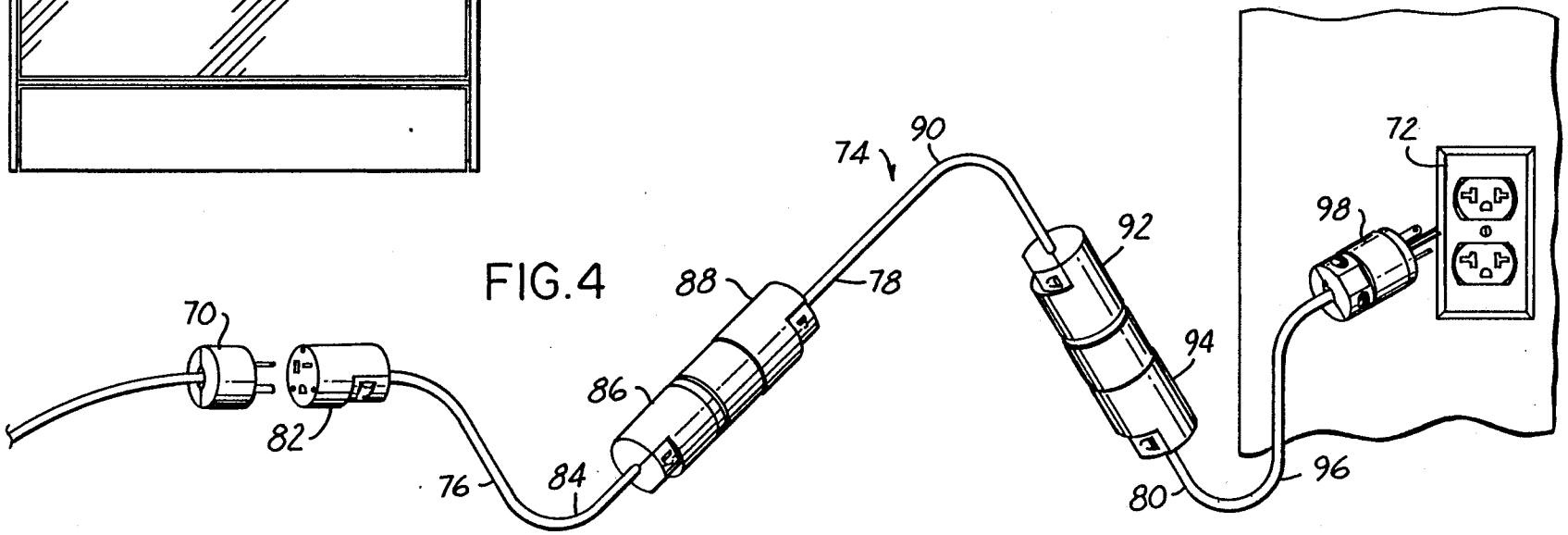
FIG. 4 is a plan view showing a three-part cable adaptor assembly for adapting a particular plug into a particular wall socket outlet.

As shown in FIG. 4, a plug 70 is adapted for use with wall socket 72 wherein at least three types of plug and socket configurations are commonly used. A cable adaptor assembly 74 consists of three cable members: a first cable member 76, a second cable member 78 and a third cable member 80. First cable member 76 consists of a first configuration of socket member 82, hereinafter called a type A socket, that is connected by cord 84 to plug 86 of the second configuration, hereinafter called a type B plug. The second cable member 78 consists of a socket 88 of type B configuration that corresponds to plug 86. This socket 88 is connected by cord 90 to plug 92 of a third configuration, hereinafter called type C. Third cable member 80 consists of a socket member 94 of type C configuration receives plug 92 and is connected by cord 96 to plug 98 which is of type A configuration. As shown in FIG. 4, the three cable members would be acting as an extension cord. However, it is to be understood that if plug 70 were of a different configuration than wall outlet 72, all three of cable members 76, 78, 80 would not be utilized, and the cable adaptor arrangement 74 would be acting as an adaptor. For instance, if plug 70 were of type A configuration and wall outlet 72 were of type C configuration, plug 70 would be received within socket 82 in first cable member 76 which would be in turn connected through plug 86 to socket 88 of second cable member 78. Second cable 78 would have plug 92 inserted into wall outlet 72. That is, if plug 70 were of type A configuration and socket 72 were of type C configuration, third cable member 80 would not be utilized to connect plug 70 to socket 72.

The method of using either the two-part cable adaptor assembly 20 or the three-part cable adaptor assembly 74 can be easily understood from the drawings. An operator merely identifies the type of plug and wall socket that he must adapt for use with each other. If only two types of configurations are commonly used, the plug that is to be adapted will be inserted into one of the two cable members 21, 22 of the cable adaptor arrangement 20 which in turn will then have the proper male plug unit for corresponding to the particular wall socket.

If, however, three or more types of configurations are commonly used, an operator may have to cascade two or more cable members as has been described above with relation to FIG. 4.

In an embodiment, the cord connecting the plug and socket may be 10 inches long and formed of 12 gauge wire.

A working embodiment of the present invention has been described; however, it is to be understood that the intended scope of protection is not to be limtied by the preferred embodiment disclosed above. The intended scope of the present invention can be best understood upon a reading of the appended claims.

We claim:

1. A combination comprising:

a first cable member comprising an electric plug and an electric socket, said first cable plug and said first cable socket being connected by an electric cord, said first cable plug being of a first configuration and said first cable socket being of a second configuration distinct from said first configuration and not compatible therewith; and a second cable member comprising an electric plug and an electric socket, said second cable electric plug and said second cable electric socket being connected by an electric cord, said second cable electric plug being of said second configuration and said second cable electric socket being of said first configuration.

2. A combination as recited in claim 1, wherein said first cable plug can be inserted in said second cable socket while said second cable plug is simultaneously inserted in said first cable socket.

3. A combination comprising:

a first cable member comprising an electric plug and an electric socket, said first cable plug and said first cable socket being connected by an electric cord, said first cable plug being of a first configuration and said first cable socket being of a second configuration distinct from said first configuration and not compatible therewith;

a second cable member comprising an electric plug and an electric socket, said second cable plug and said second cable socket being connected by an electric cord, said plug of said second cable member being of said second configuration and said socket of said second cable member being of a third configuration distinct from either of said first or second configurations and not compatible therewith; and a third cable member comprising an electric plug and an electric socket, said third cable plug and said third cable socket being connected by an electric cord, said plug of said third cable member being of said third configuration.

4. A combination as recited in claim 3, wherein said third cable socket member is of said first configuration.

5. A combination as recited in claim 4, wherein said first cable plug can be inserted in said third cable socket while said second cable plug is simultaneously inserted in said first cable socket and said third cable plug is simultaneously inserted in said second cable socket.

6. A method of adapting a particular electric plug to a particular electric socket, wherein the plug and sockets are of distinct configurations commonly found, consisting of preparing two cable members, each cable member having a plug and socket that are interconnected by an electric cord, a first of said cable members having a first configuration of plug and a second configuration of socket that is distinct from the first configuration, and the second cable member having a plug with the second configuration and a socket of the first configuration;

identifying a particular plug that is to be adapted for use with a particular electric outlet and identifying the type of configurations of each of the plug and the outlet; and if the plug is of a distinct configuration from the wall socket, selecting the one of the two cable members that have a socket corresponding to the plug that is to be adapted and a plug corresponding to the wall socket that it is to be adapted for use with.

7. A method as recited in claim 6, and wherein the first and second cable members are maintained in a stored position with the first cable member plug being received in the second cable member socket and the second cable member plug being received in the first cable member socket.

8. An electric cable adaptor assembly having:

(a) a first cable member comprising an electric plug and an electric socket, said first cable plug and said first cable socket being connected by an electric cord, said first cable plug being of a first configuration and said first cable socket being of a second configuration distinct from said first configuration and not compatible therewith;

(b) a second cable member comprising an electric plug and an electric socket, said second cable electric plug and said second cable electric socket being connected by an electric cord, said second cable electric plug being of said second configuration and said second cable electric socket being of said first configuration; and (c) said first cable plug being inserted in said second cable socket while said second cable plug is simultaneously inserted in said first cable socket.

9. An electric cable adaptor assembly as recited in claim 8, and wherein said first configuration is 220 volt, 15 amp with straight blade insertion and said second configuration is 220 volt, 15 amp with twist lock insertion.

10. An electric cable adaptor assembly as recited in claim 8, and wherein said first configuration is 220 volt, 20 amp with straight blade insertion and said second configuration is 220 volt, 20 amp with twist lock insertion.

11. An electric cable adaptor assembly as recited in claim 8, and wherein said first configuration is 120 volt, 15 amp with straight blade insertion and said second configuration is 120 volt, 15 amp with twist lock insertion.

12. An electric cable adaptor assembly as recited in claim 8, and wherein said first configuration is 120 volt, 20 amp with straight blade insertion and said second configuration is 120 volt, 20 amp with twist lock insertion.

13. An electric cable combination comprising:

(a) a first electric cable member comprising electric plug means and electric socket means, said first cable plug means and said first cable socket means being connected by an electric cord, said first cable plug means being of a first configuration and said first cable socket means being of a second configuration distinct from said first configuration and not compatible therewith;

a second cable member comprising electric plug means and electric socket means, said second cable plug means and said second cable socket means being connected by an electric cord, said second cable plug means being of said second configuration and said second cable socket means being of a third configuration distinct from either of said first or second configurations and not compatible therewith; and a third cable member comprising electric plug means and electric socket means, said third cable plug means and said third cable socket means being connected by an electric cord, said third cable plug means being of said third configuration.

14. A combination as recited in claim 13, wherein said third cable socket means is of said first configuration.

15. A combination as recited in claim 14, wherein said first cable plug means can be inserted in said third cable socket means while said second cable plug means is simultaneously inserted in said first cable socket means and said third cable plug means is simultaneously inserted in said second cable socket means.

16. A method of adapting a particular electric plug to a particular electric socket, wherein the plug and sockets are of distinct configurations commonly found, consisting of preparing two cable members, each cable member having a plug and socket that are interconnected by an electric cord, a first of said cable members having a first configuration of plug and a second configuration of socket that is distinct from the first configuration, and the second cable member having a plug with the second configuration and a socket of the first configuration;

maintaining the first and second cable in a stored position with the first cable member plug being received in the second cable member socket and the second cable member plug being received in the first cable member socket;

identifying a particular plug that is to be adapted for use with a particular electric outlet and identifying the type of configurations of each of the plug and the outlet; and if the plug is of a distinct configuration from the wall socket, selecting the one of the two cable members that have a socket corresponding to the plug that is to be adapted and a plug corresponding to the wall socket that it is to be adapted for use with.

17. A method as recited in claim 16, wherein the first configuration is 220 volt, 15 amp with straight blade insertion and the second configuration is 220 volt, 15 amp with twist lock insertion.

18. A method as recited in claim 16, wherein the first configuration is 220 volt, 20 amp with straight blade insertion and the second configuration is 220 volt, 20 amp with twist lock insertion.

19. A method as recited in claim 16, wherein the first configuration is 120 volt, 20 amp with straight blade insertion and the second configuration is 120 volt, 20 amp with twist lock insertion.

20. A method as recited in claim 16, wherein the first configuration is 120 volt, 15 amp with straight blade insertion and the second configuration is 120 volt, 15 amp with twist lock insertion.

21. A method as recited in claim 16, wherein a plug on a threadmill is adapted to a power shut-off socket and the power shut-off plug is in turn adapted to a wall outlet.

* * * * *